US006904685B1

(12) United States Patent
Yeh

(10) Patent No.: US 6,904,685 B1
(45) Date of Patent: Jun. 14, 2005

(54) PIVOTAL DEVICE FOR SCISSORS

(76) Inventor: Wen-Ya Yeh, No. 27, Kaisuan Road, Tainan (TW)

( * ) Notice: Subject to any disclaimer, the term of this patent is extended or adjusted under 35 U.S.C. 154(b) by 0 days.

(21) Appl. No.: 10/784,621

(22) Filed: Feb. 23, 2004

(51) Int. Cl.[7] ..... B26B 13/28
(52) U.S. Cl. ..... 30/254; 30/266; 30/341
(58) Field of Search ..... 30/230, 254, 266, 30/267, 270, 341, 342, 340

(56) References Cited

U.S. PATENT DOCUMENTS 927,058 A * 7/1909 Krouse ..... 30/341
967,436 A * 8/1910 Ramsey ..... 30/267
1,555,286 A * 9/1925 Hogg ..... 30/270
1,633,441 A * 6/1927 Firth ..... 30/267
2,395,897 A * 3/1946 Ketheart ..... 30/230
3,170,237 A * 2/1965 Weidauer ..... 30/268
3,672,053 A * 6/1972 Wiss ..... 30/267
5,517,761 A * 5/1996 Wang ..... 30/254
6,367,155 B2 * 4/2002 Homann ..... 30/140

* cited by examiner

*Primary Examiner*—Hwei-Siu C. Payer
(74) *Attorney, Agent, or Firm*—Alan D. Kamrath; Nikolai & Mersereau, P.A.

(57) ABSTRACT

A pair of scissors includes two scissor elements and a pivotal device. Each scissor element includes a countersink extending from a first side thereof through a second side thereof. The pivotal device includes a screw and a nut. The screw includes a threaded shank and an enlarged head. The nut includes a shank and an enlarged head, with a screw hole extending through the shank and the enlarged head of the nut. The nut is received in the countersink of one of the scissor elements, with the shank of the nut extending into the countersink of the other scissor element. The threaded shank of the screw is threadedly engaged with the screw hole of the nut. Thus, the contact area between the screw and the pivotable scissor elements is relatively small.

1 Claim, 6 Drawing Sheets

PIVOTAL DEVICE FOR SCISSORS

BACKGROUND OF THE INVENTION

1. Field of the Invention

The present invention relates to a pivotal device for a pair of scissors.

2. Description of the Related Art

FIGS. 5 and 6 of the drawings illustrate a pair of conventional scissors including a scissor element 1 and a second scissor element 2. The first scissor element 1 and the second scissor element 2 are pivotally connected by a pivotal device consisting of a bolt or screw 4 and a nut 6. As illustrated in FIG. 6, the first scissor element 1 includes a through-hole 7 extending from a side of the first scissor element 1 through the other side of the first scissor element 1. Further, the second scissor element 2 includes a countersink 8 extending from a side of the second scissor element 2 through the other side of the second scissor element 2. The countersink 8 includes a relatively smaller section 8*b* aligned with the through-hole 7 of the first scissor element 1 and a relatively larger section 8*a*.

The screw 4 has a threaded shank 5 extending through the relatively smaller section 8*b* of the countersink 8 and the through-hole 7 of the first scissor element 1 and then engaged with a screw hole (3) of the nut 6, with an enlarged head 4*a* of the screw 4 being fittingly received in the relatively larger section 8*a* of the countersink 8.

Nevertheless, the pivotal arrangement is apt to be loosened, as the screw 4 directly contacts with and thus might move together with the first scissor element 1 and the second scissor element 2 that pivot relative to each other during use of the pair of scissors. Further, the exposed nut 6 may interfere with operation of the pair of scissors.

SUMMARY OF THE INVENTION

In accordance with an aspect of the invention, a pair of scissors in accordance with the present invention includes a first scissor element, a second scissor element, and a pivotal device for pivotally engaging the first scissor element with the second scissor element. The first scissor element includes a countersink extending from a first side of the first scissor element through a second side of the first scissor element. The countersink of the first scissor element has a relatively larger section facing away from the second scissor element and a relatively smaller section facing the second scissor element.

The second scissor element includes a countersink extending from a first side of the second scissor element through a second side of the second scissor element. The countersink of the second scissor element has a relatively larger section facing away from the first scissor element and a relatively smaller section facing the first scissor element and aligned with the relatively smaller section of the countersink of the first scissor element.

The pivotal device includes a screw and a nut. The screw includes a threaded shank and an enlarged head. The nut includes a shank and an enlarged head, with a screw hole extending through the shank and the enlarged head of the nut.

The nut is received in the countersink of the first scissor element, with the enlarged head of the nut being received in the relatively larger section of the countersink of the first scissor element, and with the shank extending through the relatively smaller section of the countersink of the first scissor element and the relatively smaller section of the countersink of the second scissor element.

The threaded shank of the screw is threadedly engaged with the screw hole of the nut, with the enlarged head of the screw being received in the relatively larger section of the countersink of the second scissor element.

Thus, the contact area between the screw and the pivotable scissor elements is relatively small as compared to the conventional designs. Thus, the screw is less likely to move when the scissor elements pivot. The risk of loosening of the screw and/or the nut is reduced. A reliable pivotal arrangement is provided accordingly.

Other objects, advantages, and novel features of the invention will become more apparent from the following detailed description when taken in conjunction with the accompanying drawings.

DETAILED DESCRIPTION OF THE PREFERRED EMBODIMENT

Referring to FIGS. 1 through 4, a pair of scissors 1 in accordance with the present invention comprises a first scissor element 11, a second scissor element 12, and a pivotal device for pivotally engaging the first scissor element 11 with the second scissor element 12.

Figure 1:
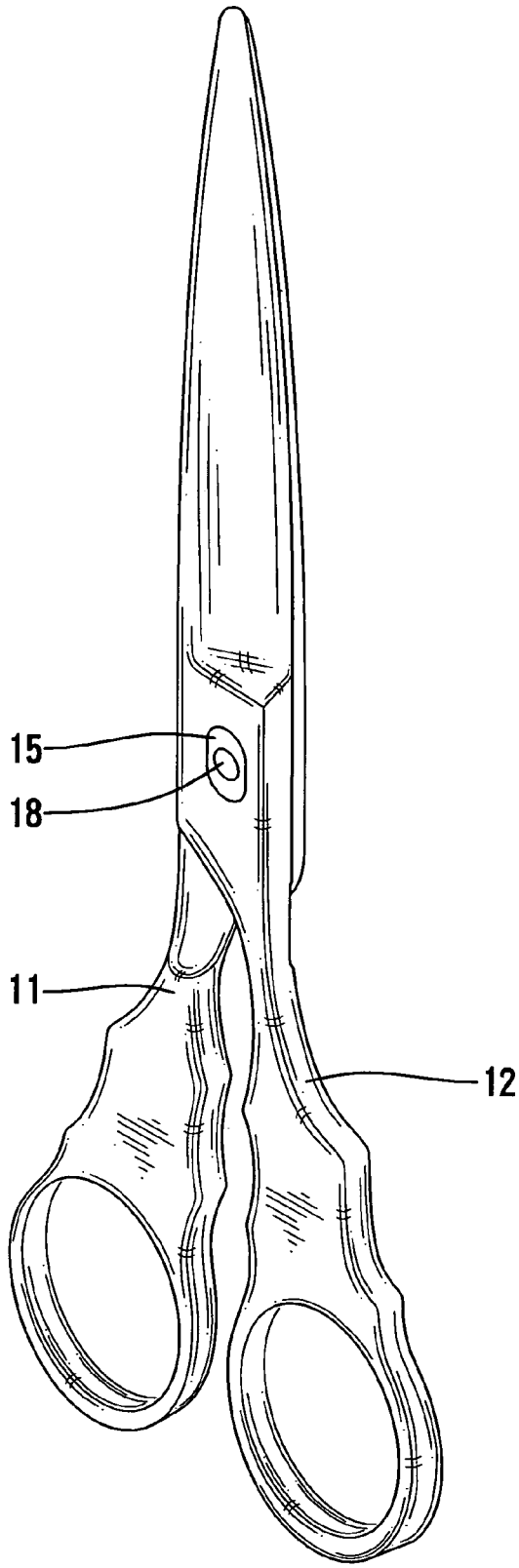
FIG. 1 is a perspective view of a pair of scissors in accordance with the present invention.
Figure 2:
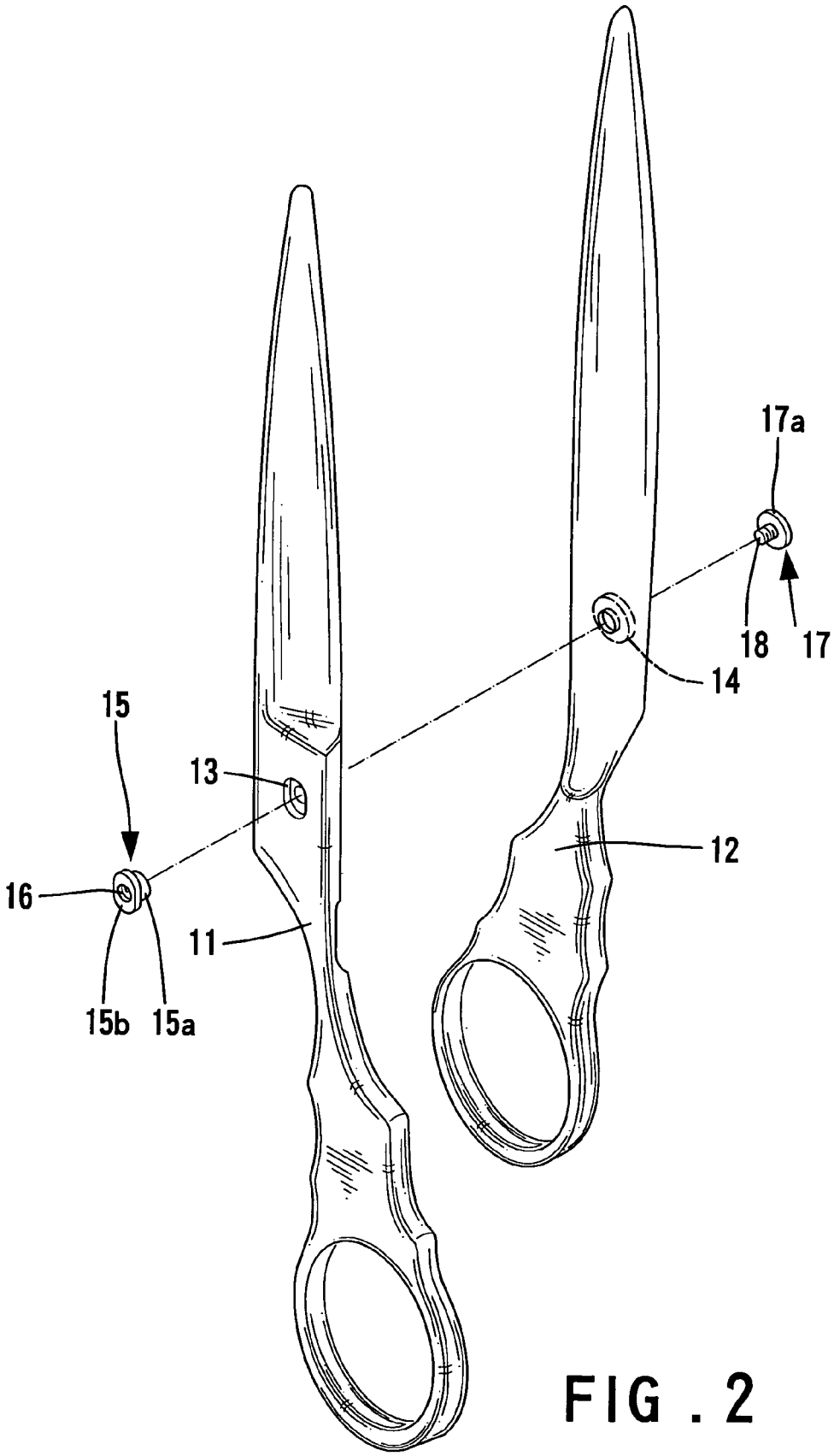
FIG. 2 is an exploded perspective view of the pair of scissors in accordance with the present invention.
Figure 3:
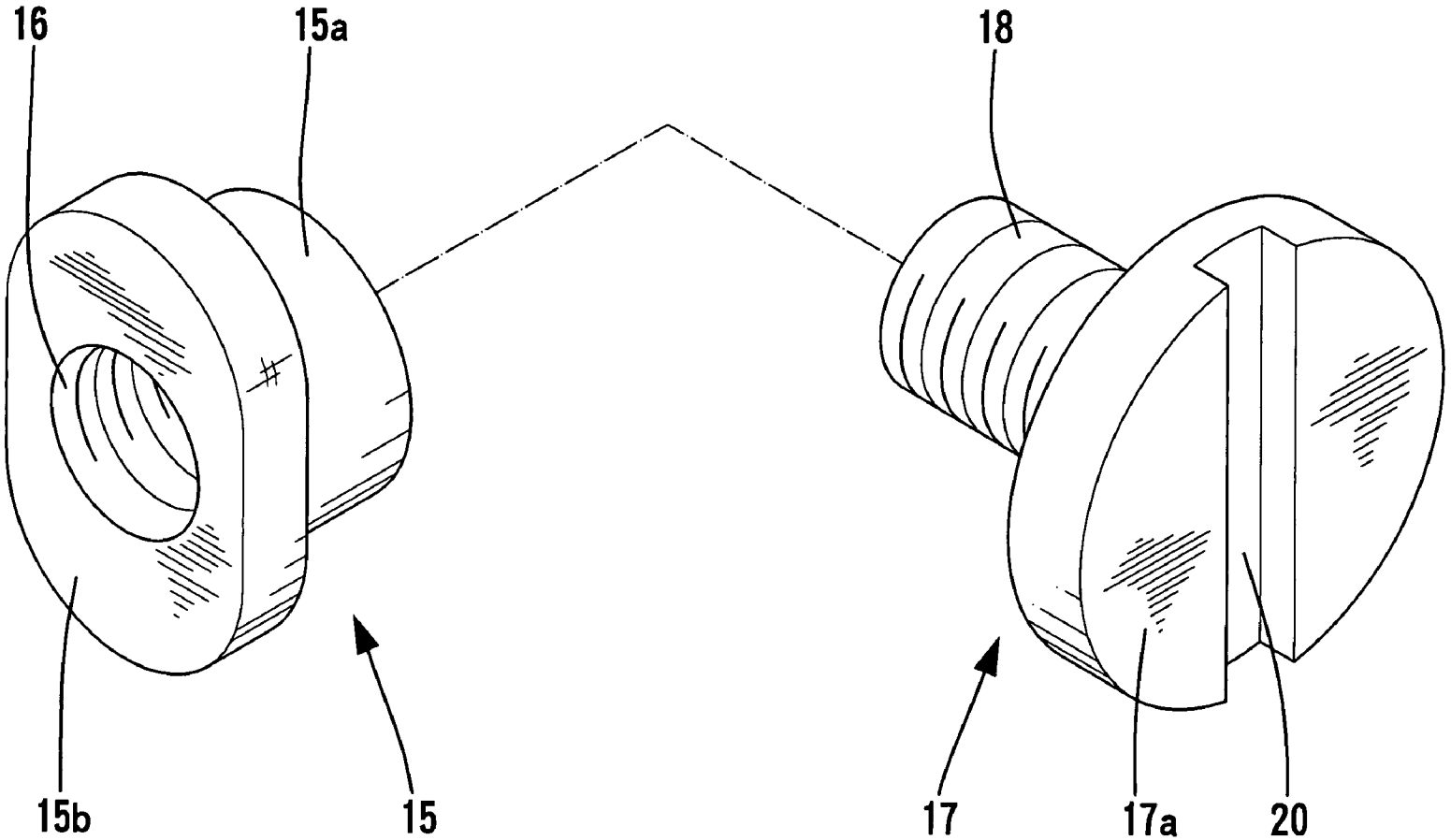
FIG. 3 is an enlarged exploded perspective view of a pivotal device of the pair of scissors in accordance with the present invention.
Figure 4:
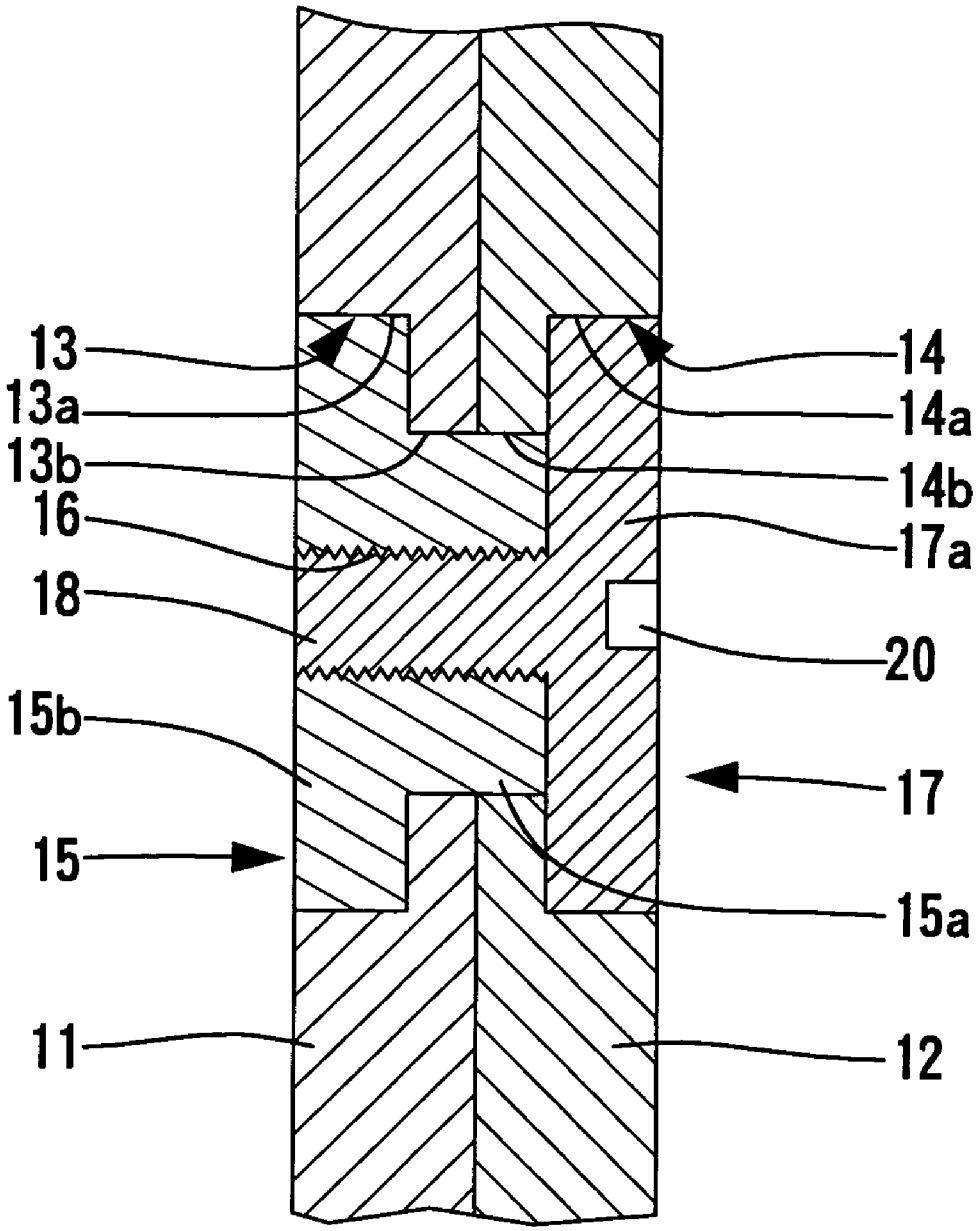
FIG. 4 is a sectional view illustrating pivotal arrangement of the pair of scissors in accordance with the present invention.
Figure 5:
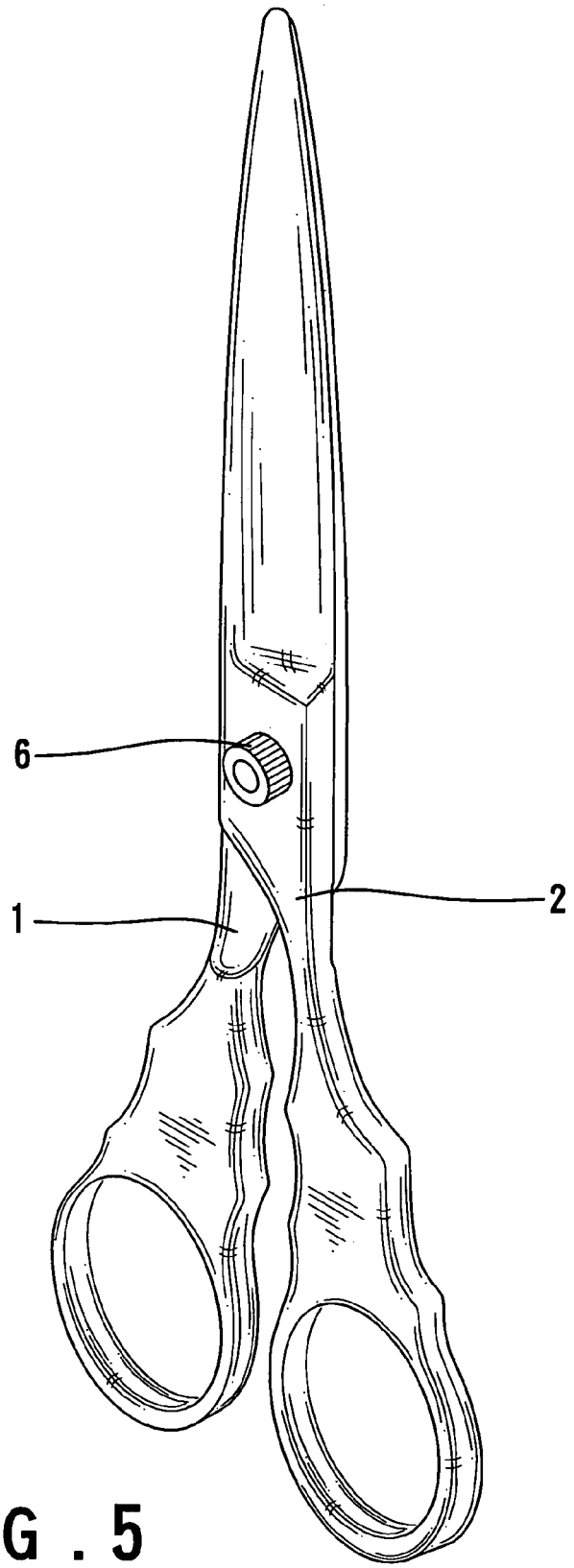
FIG. 5 PRIOR ART
FIG. 5 is a perspective view of a pair of conventional scissors.
Figure 6:
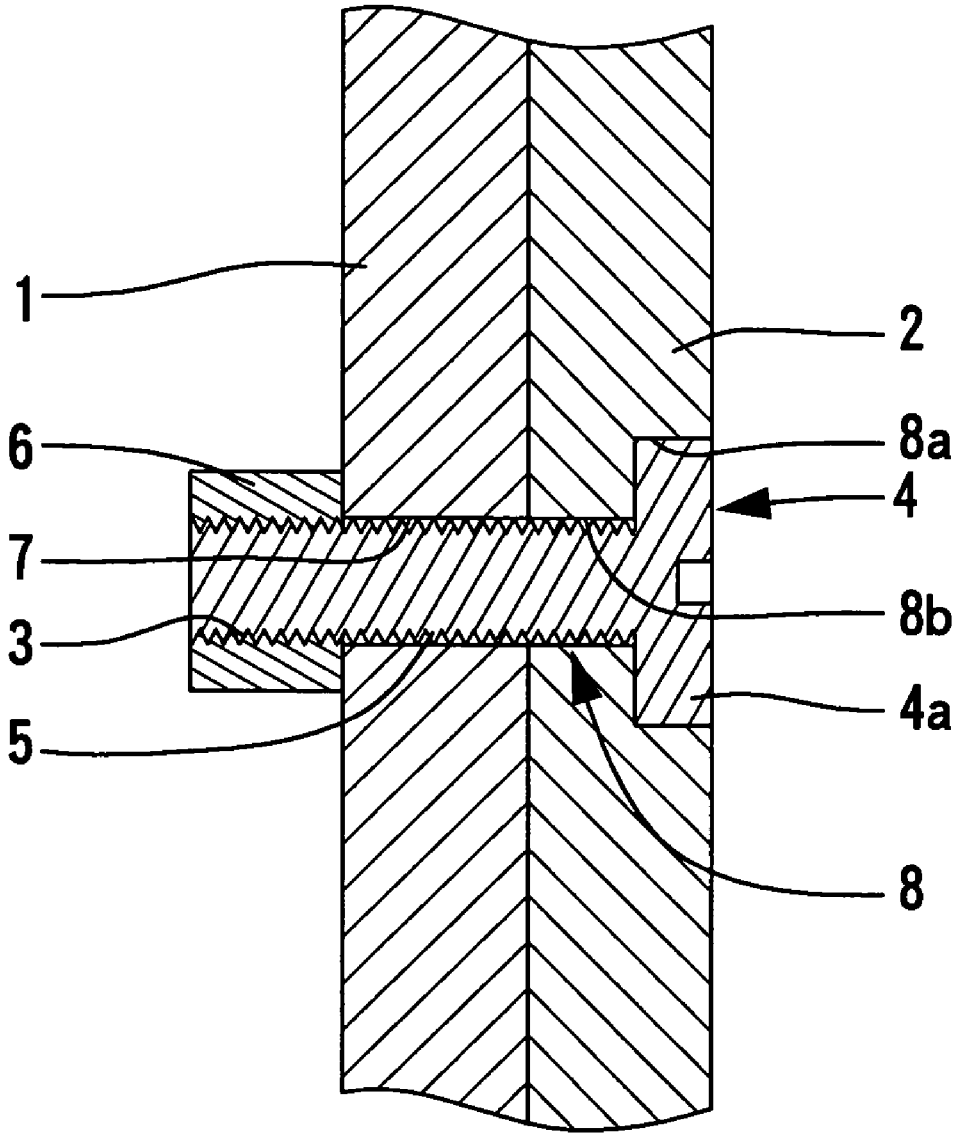
FIG. 6 PRIOR ART
FIG. 6 is a sectional view illustrating pivotal arrangement of the pair of conventional scissors.

As illustrated in FIG. 4, the first scissor element 11 includes a countersink 13 extending from a first side of the first scissor element 11 through a second side of the first scissor element 11. The countersink 13 of the first scissor element 11 has a relatively larger section 13*a* facing away from the second scissor element 12 and a relatively smaller section 13*b* facing the second scissor element 12.

Similarly, the second scissor element 12 includes a countersink 14 extending from a first side of the second scissor element 12 through a second side of the second scissor element 12. The countersink 14 of the second scissor element 12 has a relatively larger section 14*a* facing away from the first scissor element 11 and a relatively smaller section 14*b* facing the first scissor element 11 and aligned with the relatively smaller section 13*b* of the countersink 13 of the first scissor element 11.

The pivotal device includes a bolt or screw 17 and a nut 15. The screw 17 includes a threaded shank 18 (having an outer threading) and an enlarged head 17*a*. The nut 15 includes a shank 15*a* and an enlarged head 15*b*, with a screw hole 16 extending through the shank 15*a* and the enlarged head 15*b*.

In assembly, as illustrated in FIG. 4, the nut 15 is inserted into the countersink 13 of the first scissor element 11, with the enlarged head 15*b* being fittingly received in the relatively larger section 13*a* of the countersink 13, and with the shank 15*a* extending through the relatively smaller section 13*b* of the countersink 13 of the first scissor element 1 and the relatively smaller section 14*b* of the countersink 14 of the second scissor element 12. Next, the threaded shank 18 of the screw 17 is threadedly engaged with the screw hole 16 of the nut 15 until the enlarged head 17*a* of the screw 17 is fittingly received in the relatively larger section 14*a* of the countersink 14 of the second scissor element 12. The enlarged head 17*a* of the screw 17 includes a slot 20, allowing the user to drive the screw 17 with a screwdriver or the like.

As can be seen from FIG. 4, the screw 17 is not in contact with the first scissor element 11, and the screw 17 is in contact with the second scissor element 12 at the enlarged head 17*a*. Thus, the contact area between the screw 17 and the pivotable scissor elements 11 and 12 is relatively small as compared to the conventional designs. Thus, the screw 17 is less likely to pivot when the scissor elements 11 and 12 pivot. The risk of loosening of the screw 17 and/or the nut 15 is reduced. A reliable pivotal arrangement is provided accordingly.

Although the invention has been explained in relation to its preferred embodiment, it is to be understood that many other possible modifications and variations can be made without departing from the scope of the invention as hereinafter claimed.

What is claimed is:

1. A pair of scissors comprising:

a first scissor element;

a second scissor element; and a pivotal device for pivotally engaging the first scissor element with the second scissor element;

the first scissor element including a countersink extending from a first side of the first scissor element through a second side of the first scissor element, the countersink of the first scissor element having a larger section facing away from the second scissor element and a smaller section facing the second scissor element;

the second scissor element including a countersink extending from a first side of the second scissor element through a second side of the second scissor element, the countersink of the second scissor element having a larger section facing away from the first scissor element and a smaller section facing the first scissor element and aligned with the smaller section of the countersink of the first scissor element;

the pivotal device including a screw and a nut, the screw including a threaded shank and an enlarged head, the nut including a shank and an enlarged head, with a screw hole extending through the shank and the enlarged head of the nut;

the nut being received in the countersink of the first scissor element, with the enlarged head of the nut being received in the larger section of the countersink of the first scissor element, and with the shank extending through the smaller section of the countersink of the first scissor element and the smaller section of the countersink of the second scissor element; and the threaded shank of the screw being threadedly engaged with the screw hole of the nut, with the enlarged head of the screw being received in the larger section of the countersink of the second scissor element.

* * * * *